United States Patent [19]

Abrahamson

[11] 4,184,659

[45] Jan. 22, 1980

[54] RECEPTACLE SUPPORT

[76] Inventor: Erik R. Abrahamson, 5221 17th Ave. NE., Seattle, Wash. 98105

[21] Appl. No.: 968,568

[22] Filed: Dec. 11, 1978

Related U.S. Application Data

[63] Continuation-in-part of Ser. No. 842,672, Oct. 17, 1977, abandoned.

[51] Int. Cl.[2] ..... A47G 23/02; A47G 29/00

[52] U.S. Cl. ..... 248/146; 211/71; 248/DIG. 7

[58] Field of Search ..... 248/146, DIG. 7, 153, 248/152, 310, 311.1, 226.5, 227, 311.1 A, 121, 313; 211/71

[56] References Cited

U.S. PATENT DOCUMENTS

| | | | |
|---|---|---|---|
| 2,596,541 | 5/1952 | Farquaharson | 248/DIG. 7 |
| 2,702,641 | 2/1955 | Arthur | 248/DIG. 7 |
| 2,891,753 | 6/1959 | Bittle | 248/154 X |
| 2,930,561 | 3/1960 | Bittle | 248/DIG. 7 |
| 3,128,981 | 4/1964 | Puetsch et al. | 248/146 |
| 3,190,454 | 6/1965 | Brooks | 211/71 |
| 3,208,706 | 9/1965 | Clark | 248/DIG. 7 |
| 3,219,195 | 11/1965 | Mize | 211/71 |
| 3,224,717 | 12/1965 | Mott | 248/DIG. 7 |
| 3,240,459 | 3/1966 | Spohn, Jr. | 248/146 X |
| 3,290,454 | 10/1969 | Alissandratos | 248/DIG. 7 |
| 3,295,691 | 1/1969 | Bowman | 211/71 |
| 3,315,817 | 4/1969 | Hook | 211/71 |
| 3,638,802 | 2/1972 | Westerfield | 211/71 |
| 3,892,315 | 7/1975 | Johnson | 211/71 |
| 3,985,324 | 10/1976 | Larson | 211/60 T |
| 3,990,654 | 11/1976 | Michael | 211/71 X |
| 4,069,997 | 1/1978 | Weiss | 248/313 X |

*Primary Examiner*—James T. McCall
*Attorney, Agent, or Firm*—Delbert J. Barnard

[57] ABSTRACT

A downwardly directed hook for engaging an upper rim portion of a garbage can is secured to an upper portion of a post or wall. A bracket for supporting the bottom of the garbage can above the ground is secured to the same support below the hook. A can support portion of the bracket slopes upwardly from its secured end to its free end. A can support(s) at the free end contacts the bottom of the garbage can at a location offset from its center away from the post or wall. The garbage can is tipped inwardly to place a portion of its rim into engagement with the hook. Then, the lower end of the can is moved inwardly until the can is substantially vertical. When it is desired to remove the can from the support, the handles of the can are grasped and the can is pulled upon to swing the lower end of the can away from the post or wall until its upper end is free of the hook. Then, the can is lifted off from the support.

12 Claims, 13 Drawing Figures

Fig. 1
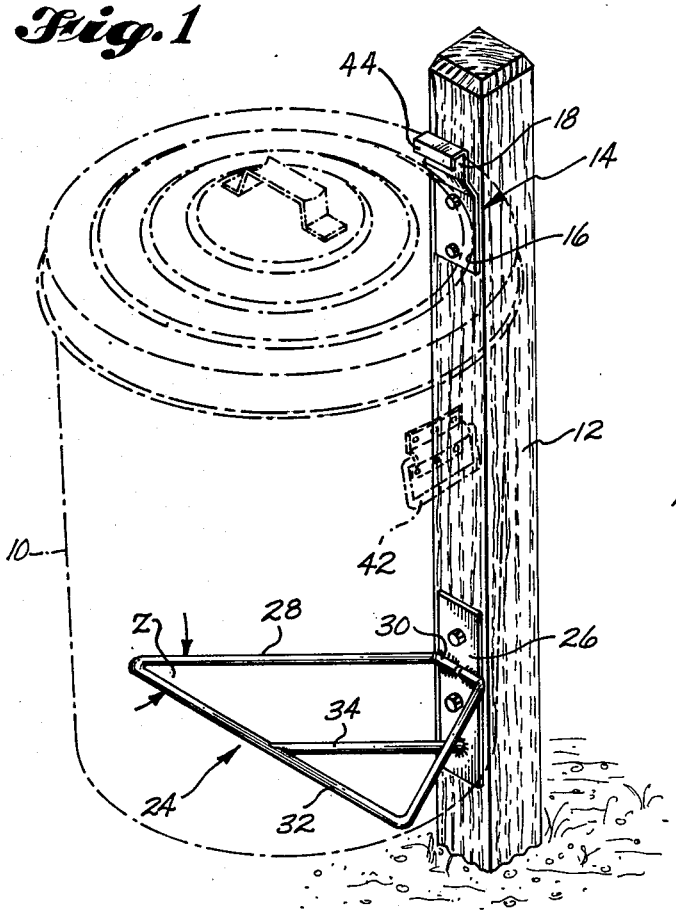
Fig. 2
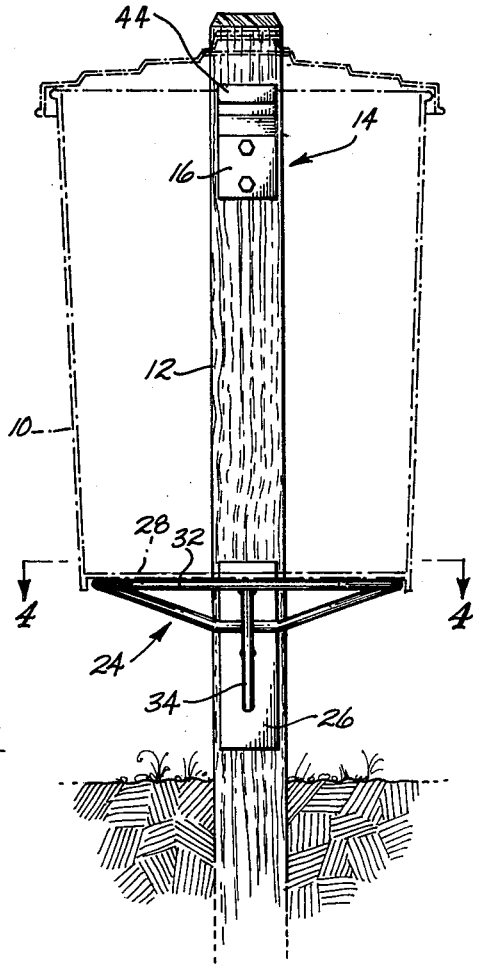
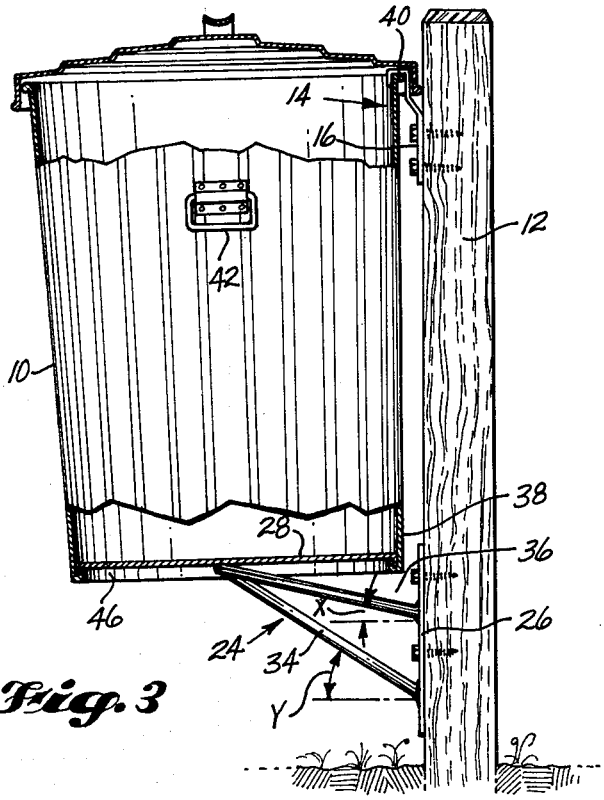
Fig. 3
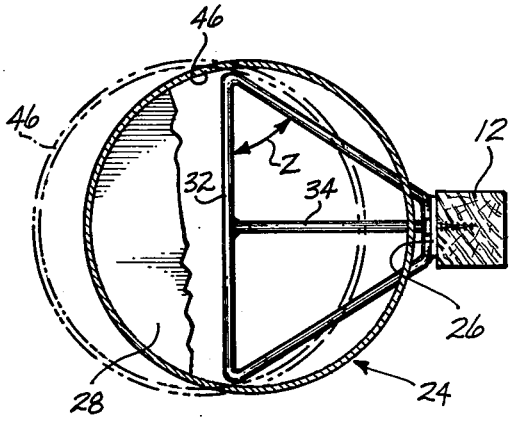
Fig. 4

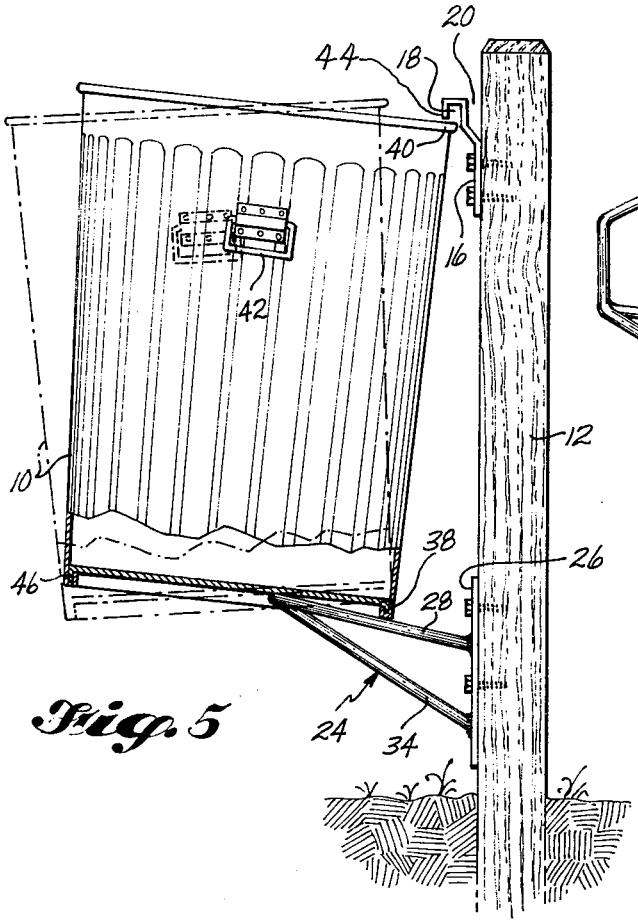
Fig. 5
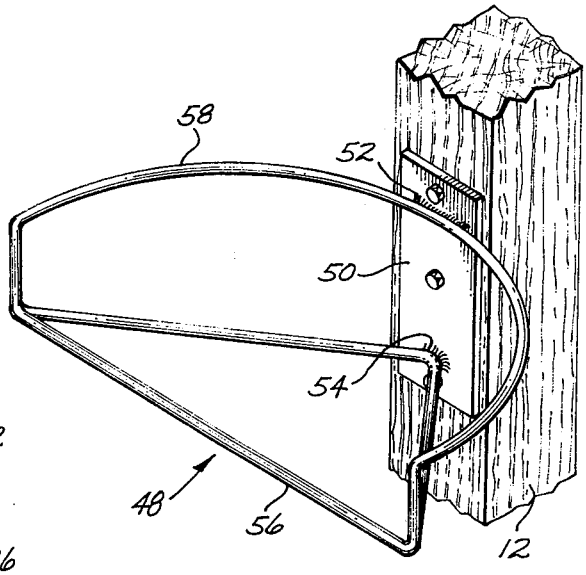
Fig. 6
Fig. 7
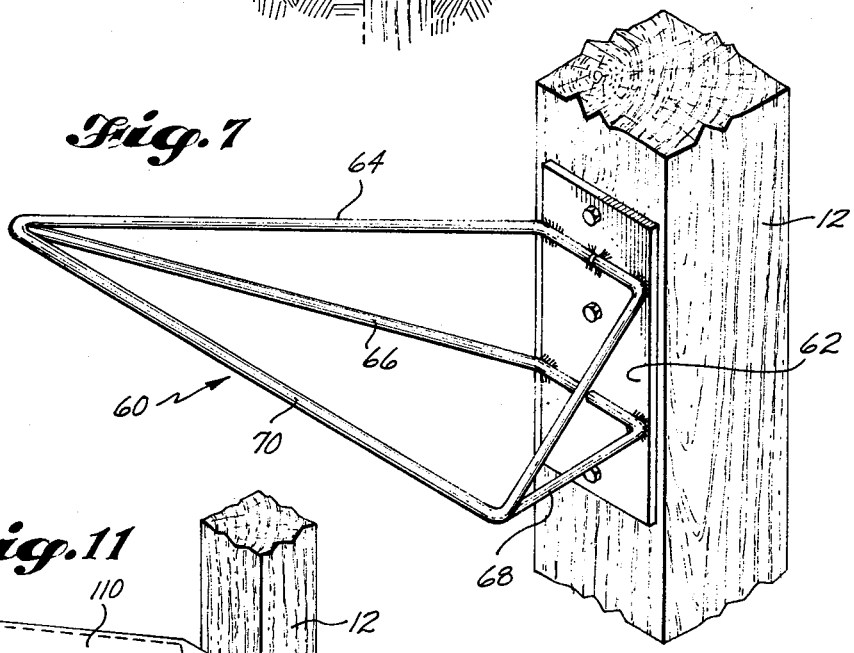
Fig. 11
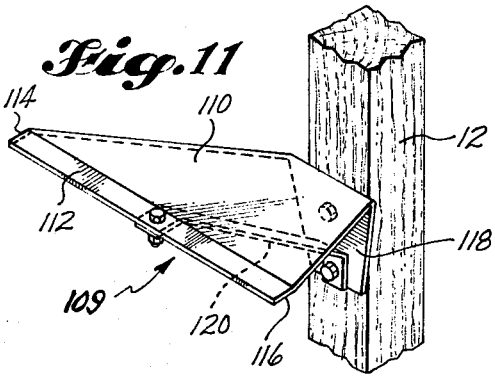

Fig. 8
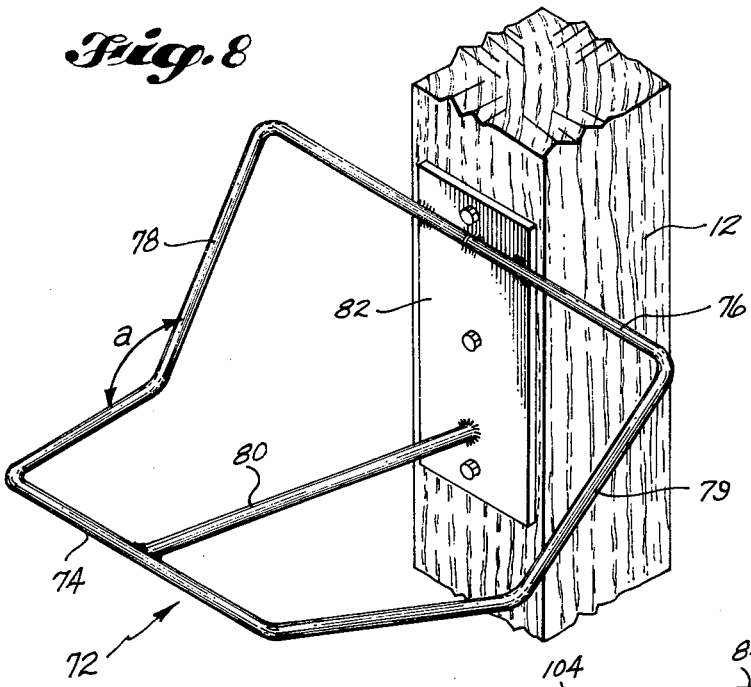
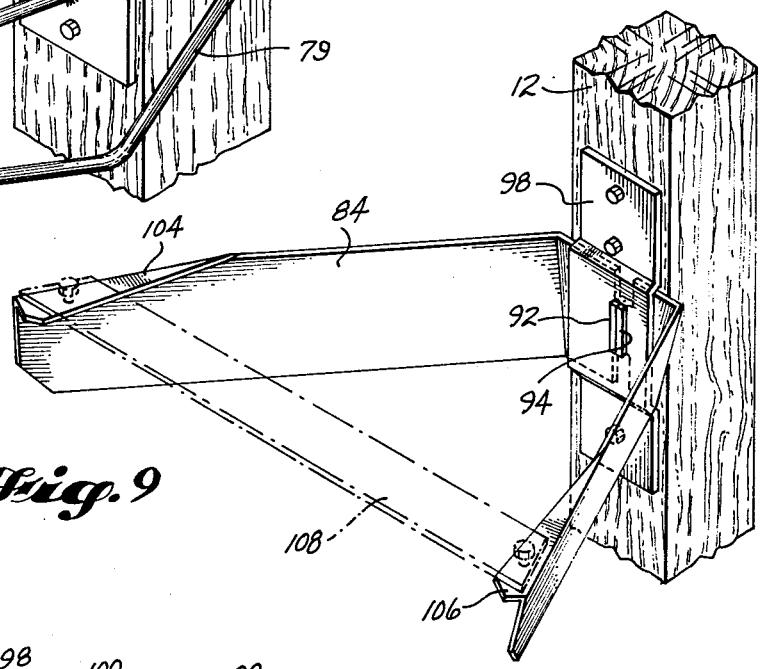
Fig. 9
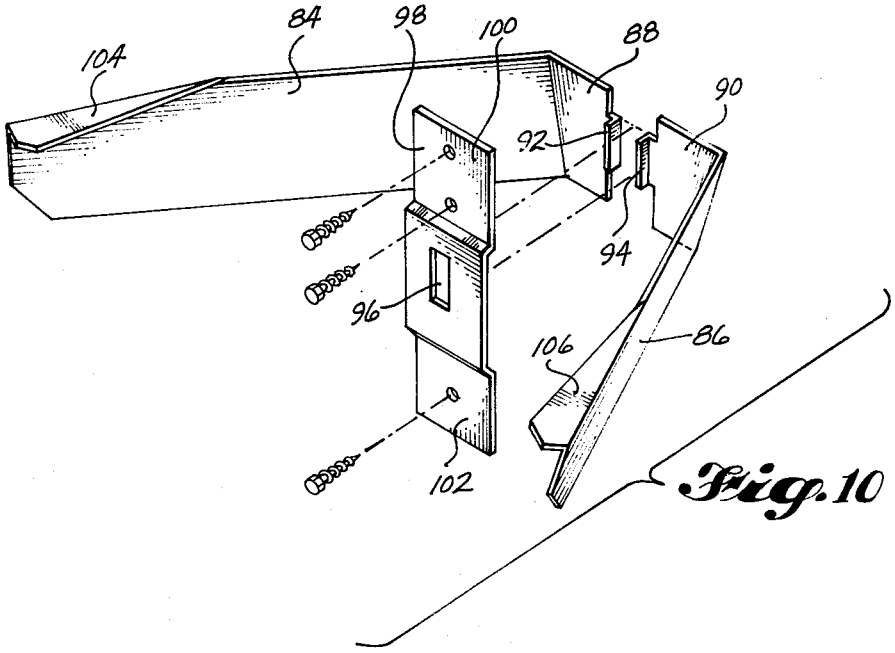
Fig. 10

RECEPTACLE SUPPORT

BACKGROUND OF THE INVENTION

Cross-Reference to Related Application

This present application is a continuation-in-part of my co-pending application, Ser. No. 842,672, filed Oct. 17, 1977, now abandoned.

Field of the Invention

This invention relates to garbage can supports, and more particularly to a quite simple and inexpensive can support adapted for easy placement and removal of the garbage can onto and from its position on the support.

Description of the Prior Art

Known garbage can supports comprise an upper hook and a lower support and/or abutment for supporting a garbage can on a vertical post or other vertical support member. Examples of such supports which can be found in the patent literature are disclosed by U.S. Pat. No. 3,128,981, granted Apr. 14, 1964, to William F. Puedsch and Clyde M. Herington; U.S. Pat. Nos. 3,219,195 granted Nov. 23, 1965, to John L. Mize; 3,240,459, granted Mar. 15, 1966, to Homer R. Spohn; 3,295,691, granted Jan. 3, 1967, to Terry D. Bowman; 3,269,619, Oct. 18, 1966, to Tacko D. Alissandratos; 3,315,817, granted Apr. 25, 1967, to Norris K. Hook; 3,892,315, granted July 1, 1975, to Anton E. Johnson; and 3,660,654, granted Nov. 9, 1976, to Sherman M. Michael.

A disadvantage of these known garbage can supports is that they all suspend the can from one of the handles. This makes it quite difficult to remove a full can from the support. Firstly, it requires the handles to be oriented at the front and rear of the can rather than at the sides. Secondly, the handle that engages the hook cannot be grasped by a full hand of the person seeking to remove the can because the hook is in the way. Such person must lift the can up free of the hook by lifting up on the free handle, and perhaps also on a rim portion of the can, and this is both awkward and difficult when the can is full of garbage and quite heavy.

U.S. Pat. No. 3,208,706, granted Sept. 28, 1965, to C. L. Clark, discloses a support for supporting the bottom of a cylindrical receptacle, such as a garbage can, and a relatively complicated foot actuated mechanism for lifting a cover of the receptacle upwardly from the receptacle. U.S. Pat. No. 3,224,717, granted Dec. 21, 1965, to R. A. Mott, discloses a similar garbage can support which includes a support ledge for hooking the lower rim of a garbage can, a pivoting latch mechanism for hooking the upper rim of the garbage can and also a relatively complicated, foot actuated mechanism for pivoting the can cover upwardly away from the can itself.

U.S. Pat. No. 3,190,454, granted June 22, 1965, to S. C. Brooks, discloses a display stand for containers, such as buckets, which stand includes a lower bracket for hooking an adjacent portion of the lower rim of bucket and a upper bracket to hook the adjacent upper rim of the bucket. To remove the bucket from the stand, the top of the bucket is first tilted inwardly to disengage it from the upper bracket; then the bucket must simultaneously be lifted upwardly off of the lower bracket and pivoted so that the bottom of the bucket moves outwardly of the lower bracket; and, finally the bucket must be lowered slightly so that the upper rim of the bucket drops below the upper bracket to clear said upper bracket. This type of motion would be very strenuous if it were required to remove a garbage can from a stand of the type of Brooks.

A dish carrier is illustrated in U.S. Pat. No. 1,167,934, granted Jan. 11, 1916, to Andor Roth, which dish carrier includes an upstanding tubular body having an integral leg which dirst extends downwardly and radially outwardly from the bottom of the tubular body to contact the surface of the counter or table and then extends vertically upwardly to bear against the bottom surface of a glass. A U-shaped member, carried by the tubular body, is provided to hook the adjacent portion of the upper rim of the glass. To remove a glass from the dish carrier of Roth, the glass must first be lifted upwardly off of the lower leg, next pivoted outwardly at its bottom to clear the lower leg, and them lowered to disengage the upper rim of the glass from the U-shaped upper member. Because the glass must also be vertically supported during these three steps, this procedure would be awkward and difficult to use to remove a full garbage can from the carrier of Roth.

U.S. Pat. No. 2,702,641, granted Feb. 22, 1955, to Oscar F. Arthur, discloses a carrier rack for drums, which includes a lower portion on which the bottom of a drum rests and an upper-hook portion which is adapted to be moved downwardly into engagement with a rim portion of the drum. U.S. Pat. No. 3,638,802 discloses a trash can holder comprising a pipe which is anchored in the ground and a second smaller-diameter pipe which is telescopically received therein. The smaller pipe includes a downwardly opening hook which is movable vertically to place it into and out from engagement with an upper-rim portion of the can.

These two patents and all of the aforementioned patents should be consulted for the purpose of properly evaluating the subject invention and putting it into proper perspective relative to the prior art.

SUMMARY OF THE INVENTION

The garbage can support of the present invention is characterized primarily by its simplicity of construction, rendering it relatively inexpensive to manufacture; by its attractiveness; and by its ease of operation. It does not utilize either handle of the garbage can, so the can may be oriented to place both handles in easy reach of a user.

The garbage can support of this invention comprises a downwardly opening hook which is secured to an upper portion of a vertical support surface, e.g., a side surface of a support post or a wall, and a support member of a unique construction on which the bottom of the can rests. According to the invention, each support for the bottom of the can is adapted to contact the can bottom, preferably at a location off center away from the vertical support surface. Such bottom support is configured to allow the inner portion of the can to drop downwardly somewhat when the can is pulled on in a direction away from the vertical support. The vertical spacing of the hook and the bottom support are such that the user can tilt the upper end of the can towards the vertical support and bring a rim portion thereof upwardly into engagement with the hook and then swing the lower end of the can inwardly until the can is substantially vertical. When it is desired to remove the can from the support, the user need only grab the two handles of the can, pull the can towards himself and away from the vertical support. As he does this the inner lower edge portion of the can will drop downwardly automatically and the can will tilt inwardly until its upper rim is free of the hook. The user can then swing the upper end of the can towards himself until it is comfortable for him to pick up and remove it from the bottom support.

In preferred form, the bottom support is in the form of a bracket which is mounted in cantilever fashion onto the vertical support, below the hook. The bracket may comprise a mounting plate, an upper member which slopes upwardly as it extends outwardly from its connection to the mounting plate, and a lower diagonal brace member which extends between a lower portion of the mounting plate and an outer portion of the upper members.

The bottom support maintains the can spaced above the ground, e.g., about one foot. The fact that the downwardly opening hook engages a rim portion of the can leaves both handles free so that they can be oriented to each side of the user as he is facing the vertical support and can always be fully grasped and used for whatever movement of the can is necessary.

The foregoing as well as other characteristic features, objects, advantages of garbage can supports of the present invention, will be apparent from the following description of a typical and therefore nonlimitative embodiment of the invention.

BRIEF DESCRIPTION OF THE DRAWINGS

Reference is now made to the accompanying illustrations of an embodiment of the invention, wherein like numerals refer to like parts, and wherein:

FIG. 1 is an isometric view of a support for a single garbage can constructed according to the present invention, with the can being shown in phantom;

FIG. 2 is a front elevational view of the structure shown by FIG. 1, also showing the can in phantom;

FIG. 3 is a side elevational view of the structure shown by FIGS. 1 and 2, showing the garbage can in full line and partially in section;

FIG. 4 is a top plan view of the lower portion of the garbage can holder, taken substantially along line 4—4 of FIG. 2;

FIG. 5 is a view similar to FIG. 3, but including a solid-line showing of the garbage can tilted inwardly toward the vertical support member until its upper rim is free of engagement with the hook, and also including a broken-line showing of the can being titled back away from the vertical support member while still resting on the bottom support member;

FIG. 6 is an isometric view of a modified form of bottom support member;

FIG. 7 is an isometric view of another modified form of bottom support member;

FIG. 8 is an isometric view of still another form of bottom support member;

FIG. 9 is an isometric view of yet another modified form of bottom support member;

FIG. 10 is an exploded isometric view of the bottom support member shown by FIG. 9;

FIG. 11 is a small scale isometric view of yet another modified form of bottom support;

DESCRIPTION OF THE PREFERRED EMBODIMENTS

Figure 13:
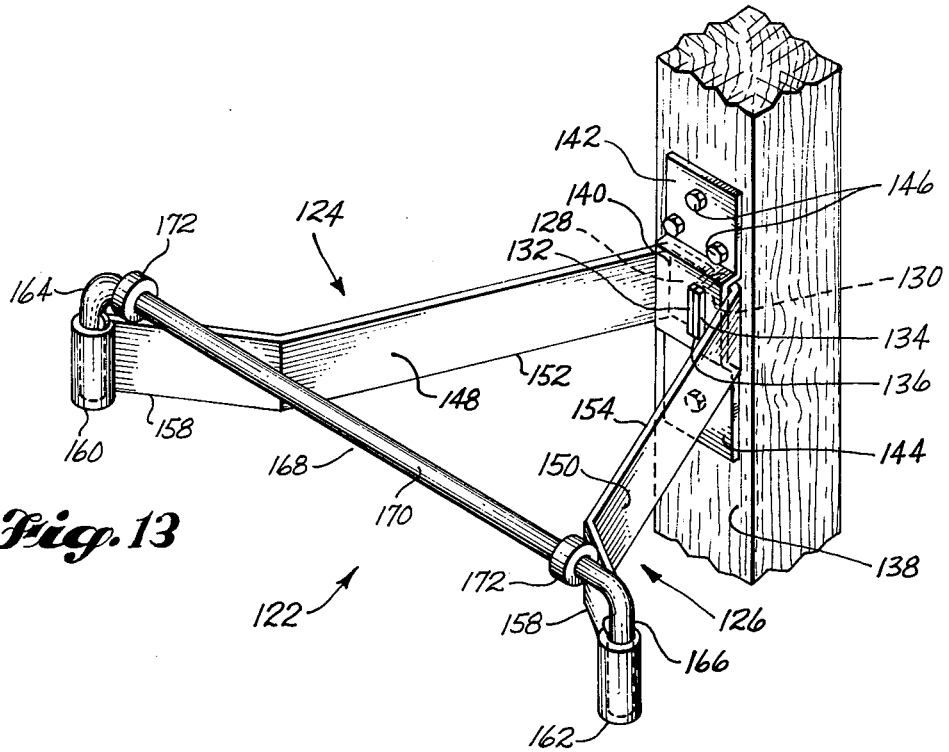
FIG. 13 is an isometric view of even another modified form of the bottom support member.

The preferred embodiments and best modes of the invention presently known to applicant are shown by the drawing and/or described below.

Referring initially to FIGS. 1 and 2, a garbage can 10 is shown to be supported in an elevated position (e.g., with its bottom spaced about one foot above the ground level) by apparatus constructed according to the present invention. The apparatus of this invention is shown mounted onto a vertical post 12 which is firmly anchored into the ground. However, it is to be understood that the apparatus could just as well be mounted onto a vertical wall or some other vertical support.

The apparatus of the present invention comprises a downwardly hook member 14 which is shown to have a shank portion 16 that is bolted or otherwise secured to the vertical support 12. The hook member 14 extends upwardly from the shank 16, then forwardly, and then downwardly, to form a downwardly opening hook throat 18. As best shown by FIG. 5, the hook portion of hook member 14 may be offset forwardly of shank 16. This is done to provide space 20 behind the hook portion for receiving a rim portion of the can lid 22 (see FIG. 3).

In preferred form, the can-holding apparatus comprises a bottom support member 24 which is secured to the vertical support 12 at a location spaced well below the hook member 14. Support bracket 24 may include a mounting plate 26 which is bolted or otherwise connected to the vertical support 12. A trapezoidal-shape closed hoop 28, constructed from rod stock (e.g., ⅜" in diameter) is connected along its short side 30 opposite its base to the mounting plate 26, such as by welding. As best shown by FIG. 3, it slopes upwardly as it extends outwardly from the mounting plate 26 to form a support shelf which terminates at its outer end in an elongated support bar 32 representing the highest elevation portion of the bracket 28. The support bar 32 is also the base of the trapezoid.

A diagonal brace 34 extends upwardly and outwardly from a lower point of connection to the mounting plate and its outer end is connected to a mid-portion of the support bar 32.

It is to be understood that there are several different ways that the support bar 32 may be constructed and supported. The important feature is that whatever bottom support is used there is contact with the bottom of the can 10 slightly forwardly of the center of the can 10 when the can 10 is vertically oriented and is engaged by the hook 14, and also that vertical space 36 (FIG. 3) be provided inwardly of where the support contacts the bottom of the can into which the lower inner portion 38 of the can 10 may be tipped for the purpose of moving the upper-rim portion 40 of the can 10 into and out from engagement with the hook 14.

Referring now to FIGS. 2 and 3, to mount an empty garbage can 10 onto the support the user grasps the two handles 42 and walks generally directly towards the post 12 or other vertical support. He may rest the bottom of the can on the bottom support bar 32 with the can 10 leaning away from him so that the lowered forward upper-edge portion 40 of the 10 is below the lower edge of the front wall 44 of the hook 14 and in a position to be moved upwardly into the mouth 18 of the hook 14. The lower end of the can is then slid inwardly until the can is generally vertically oriented as shown in FIG. 3 of the drawing. In this position, the can is relatively stable and is essentially restrained against movement in all directions. It cannot be easily tipped over by a dog or other animal. The opposite end portions of the support bar 32 can lock against the lower depending rim 46 on the can to keep the can from being slid sideways off of the support bar 32. Also, the hook 14 locks the can 10 against much movement. As garbage is added to the can 10, the weight of the garbage helps hold the can 10 in place.

When it is desired to remove the can 10 from the holding means, such as when it becomes necessary to empty the can 10, the person doing the removing may step up to the can 10, grasp the two side-oriented handles 42, and then pull back on the handles 42 so that the can 10 will once again lean away from him. The can 10 is tilted in this manner until its upper-edge portion 40 is moved out of engagement with the hook 14. Then, the person may tilt the can towards himself and lift it off from the support bar 32.

Referring to FIG. 4, because of the fact that the bar 32 is located slightly off-center relative to the bottom of the can, and away from the post 12, its end can be located close enough to the rim 46 so that the bar 32 will prevent unwanted sideways movement of the can relative to the support bracket 24. This arrangement also results in the bar 32 being shorter than the diameter of the bottom of the can, inside of the rim 46. This allows some front-to-rear movement of the can while on the bar 32, as shown by FIG. 4. FIG. 4 includes a solid-line showing of the position of the rim 46 when the can is substantially vertically supported (the FIG. 3 condition) and a broken-line showing of the position of the can when it is tilted toward the post 12 (the FIG. 5 condition).

By way of typical and therefore nonlimitative example, the angle X between the plane of the trapezoidal frame member 28 and the horizontal plane may be about 12°. The angle of inclination Y of brace member 34 may be about 30°. The internal angles Z at the forward corners of frame 28 may be about 60°.

The form of bracket 48 shown by FIG. 6 comprises a mounting plate 50 by which it is bolted or otherwise attached to the post 12 and metal frame attached to the plate 50, such as by welding at 52, 54. The frame may be constructed from 0.375CR5 rod with a galvanized finish. It is shown to include a triangular lower portion having a base 56, which serves as the bottom support for the garbage can. The general plane of such triangular lower portion may also be inclined about 12° and the bar 56 may be located at essentially the same location as bar 32 in the earlier form (see FIG. 4), i.e., slightly off-center relative to the can in a direction away from the post 14. This form of bracket includes a semicircular retainer hoop 58 which partially surrounds a lower portion of the garbage can. As should be evident, the hook 58 will prevent sideways movement of the can relative to the post, i.e., movement lengthwise of the support bar 56.

The form of bracket 60 shown by FIG. 7 also includes a mounting plate 62, a trapezoidal-shaped upper frame portion 64, which may be identical to its counterpart in bracket 24. However, instead of having a single lower brace, it may comprise a pair of lower brace member 66, 68, which together with the forward bar 70 would define a second trapezoidal figure. The support bars 66, 68 may also be inclined about 30°, for example. In this form, the bar 70 is positioned at the same location as bar 32 in the bracket 24.

The bracket 72 shown by FIG. 8 comprises a closed loop, which is somewhat trapezoidal in shap and includes a short forward base 74, a longer rear base 76, and dihedrally bent side members 78, 79. The angle a of bend of the side members 78, 79 may be about 115°. The forward portion of this frame which includes the bar 74 may be upwardly inclined about 12°, as in the earlier embodiments. The rear portions of the side members 78, 79 are spaced apart a sufficient distance to allow the lower-rear portion of the garbage can to set inside them. The closed-loop frame may be braced by a single brace member 80 extending from the mounting plate 82 forwardly to a point of connection with the midportion of bar 74.

FIGS. 9 and 10 disclose a sheet metal form of bracket. By way of example, it may be constructed from a ten-gauge CRS material having a galvanized finish. It may comprise a pair of side parts 84, 86, each being bent at its rear to form a rear wall 88, 90 and a forwardly directed flange 92, 94, which are sized to together fit within an opening 96 provided in a mounting plate 98. The central portion of mounting plate 98 is offset forwardly from end portions 100, 102 an amount substantially equal to the thickness of the walls 88, 90. As shown by FIG. 9, the two side members 84, 86 are moved together and the flanges 92, 94 are inserted through the opening 96 and then the assembly is moved toward the post 12 and bolted in place.

The outer ends of arms 84, 86 are bent inwardly at the corners 104, 106 to provide flat support surfaces for the bottom of the garbage can. Optionally, a cross-member 108 may be secured between the corner flanges 104, 106 to provide additional support under the bottom of the garbage can, e.g., for supporting the flexible bottom of a plastic garbage can.

The side arms 84, 86 also slope upwardly as they extend outwardly from the post 12, e.g., about 12°.

The bottom support 108 shown by FIG. 11 is formed from sheet metal. It has an outwardly extending sloping part 110 which slopes upwardly (e.g. about 12°) and which terminates in a can bottom supporting portion 112 which is equivalent to bar 32 in the first form. Portion 112 is located at the same position as bar 32 and the distance between end points 114, 116 is smaller than the diameter of the can bottom for the reason discussed above in connection with FIG. 4. Part 110 is integral with a mounting plate 118. In this form a brace 120 is bolted at its ends to the sheet metal member.

Figure 12:
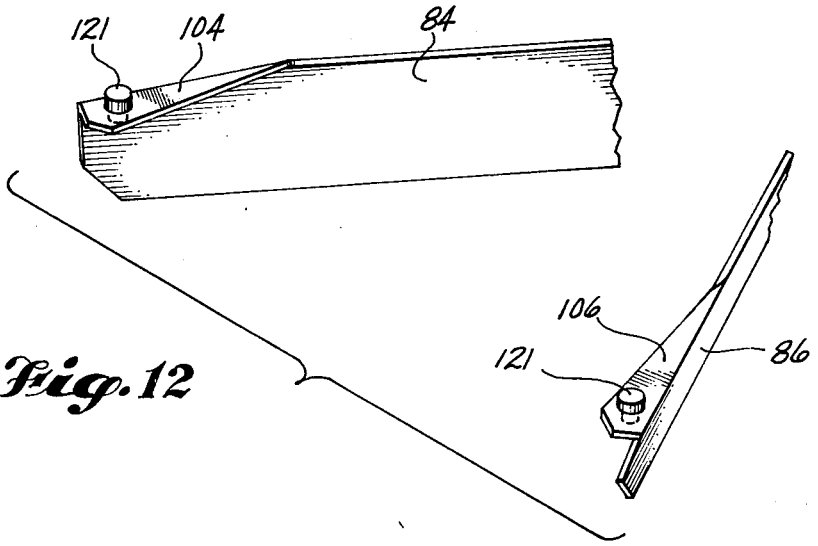
FIG. 12 is a fragmentary isometric view illustrating a friction member attached to the corner flanges of the bracket shown in FIG. 10.

Now referring specifically to FIG. 12, cushion members 121 are mounted on corner flanges 104 and 106 to project above said flanges to bear against the bottom the garbage can. Said cushion members are prefereably made of an elastomer material, such as rubber, to prevent abrasive metal-to-metal contact between the corner flanges 104 and 106 and the bottom of the garbage can and also to frictionally bear against the bottom of the garbage can to prevent the can from sliding relative to arms 84 and 86.

FIG. 13 discloses a bracket 122 which is partially constructed of sheet metal material and which includes two oppositely-formed halves, a first half 124 and a second half 126. Said two halves each has a rear wall 128 and 130, respectively, extending laterally toward each other and each has a flange 132 and 134, respectively which projects forwardly from the end portions of the two rear walls 128, 130 which are adjacent to each other. Flanges 132 and 134 are sized to together closely fit within a slot 136 provided in a formed mounting plate 138. Mounting plate 138 includes a central portion 140, which is offset forwardly from vertically spaced end portions 142, 144 an amount substantially equal to the thickness of bracket rear walls 128 and 130. As best shown in FIG. 13, when the two halves 124, 126 are placed adjacent to each other, the flanges 132, 134 are receivable through slot 136 and bracket rear walls 128 and 130 are sandwiched between mounting plate central portion 140 and post 12 to which mounting plate 138 is bolted through the use of standard fasteners such as wood screws 146.

Each bracket half 124 and 126 includes a horizontally disposed, formed arm 148 and 150, respectively, which two arms each include an inward section 152 and 154, respectively, extending outwardly and laterally from corresponding rear walls 128 and 130. Arms 148 and 150 also include outward sections 156 and 158 which extend further laterally and outwardly from the outward ends of the corresponding arm inward sections 152 and 154. The free end portions of each outward section 156 and 158 is curled to form vertically extending knuckles 160 and 162, respectively, for slideagly receiving downwardly directed terminal portions 164 and 166 of a horizontally disposed, laterally directed cross member 168. Cross member 168 is shown as being formed from a round rod; however, rods of other shapes such as square or rectangular can also be used. Furthermore, other structural components, such as tubular members, can be used in place of rod 168.

Main body portion 170 of rod 168, is illustrated in FIG. 18 as at an elevation above arms 148, 150 to enable the bottom of a full garbage can to be tilted forwardly onto said two arms when a garbage can is being disengaged from hook 14 in a manner similar to that shown in FIG. 5.

A pair of spaced apart grommets 172 tightly encircle cross member body portion 170 and serve to bear against the bottom surface of a garbage can. Grommets 172 are preferably of elastomeric material, such as rubber, for not only preventing abrasive metal-to-metal contact between cross member 168 and the bottom of the garbage can, but also to impart frictional force against the bottom of the garbage can to prevent lateral sliding movement between said garbage can bottom and bracket 122 to prevent the garbage can from being easily tipped over.

Of course, there are many other ways of constructing the support for the bottom of the garbage can. The essential characteristic of whatever form of bottom support is used is that it provides a space on the post side of the member or members which contact the bottom of the garbage can that will allow the garbage can to be inclined toward the post.

What is claimed is:

1. An apparatus for supporting a garbage can so that it cannot be easily tipped over by an animal, comprising:

downwardly opening hook means adapted to engage an upperrim portion of the garbage can;

bottom support means for elevating and supporting the bottom of the garbage can, said bottom support means including pedestal means for underlying and contacting the bottom of the garbage can when the can is engaged by said hook means and is substantially vertically oriented, said bottom support means providing open space below the bottom of the garbage can on the hood means side of the pedestal means into which the lower-inner portion of the garbage can may be tilted while on said pedestal means; and, said pedestal means being positioned to contact the bottom of the garbage can at a location sufficiently horizontally outwardly from said hook means that the distance between said pedestal contact location and said hook means is greater than the height of the garbage can to enable the rim of the garbage can to disengage from the downwardly opening hook means when the garbage can is tilted into said open space.

2. The apparatus according to claim 1, wherein the downwardly opening hook means is physically independent from said bottom support means and comprises a plate member having a lower mounting portion which includes at least one opening for receiving a screw or the like and upper portion which extends upwardly from said mounting portion, then forwardly, and then downwardly, to form a downwardly opening hook for closely fitting the upper rim portion of the garbage can.

3. Apparatus for supporting a garbage can so that it cannot be easily tipped over by an animal, comprising:

downwardly opening hook means adapted to engage an upper-rim portion of the garbage can;

bottom support means for elevating and supporting the bottom of the garbage can, said bottom support means including pedestal means for underlying and contacting the bottom of the can when the can is engaged by said hook means and is substantially vertically oriented, said bottom support means providing open space below the bottom of the garbage can of the hook means side of the pedestal means into which the lower-inner portion of the garbage can may be tilted while on the pedestal means, for the purpose of disengaging the rim of the garbage can from the downwardly opening hook means; and, when the garbage can is supported on the apparatus the pedestal means contacts the bottom of the garbage can at locations offset from the center of the garbage can bottom in the direction away from said hook means.

4. The apparatus according to claim 1, for use with a garbage can having a lower rim depending below the level of the bottom, and wherein said pedestal means is sized to fit entirely and relatively closely within the perimeter of the depending rim to substantially restrict relative transverse movement between said pedestal means and the garbage can.

5. Apparatus for supporting a garbage can so that it cannot be easily tipped over by an animal, comprising:

downwardly opening hook means adapted to engage an upper-portion of the garbage can;

bottom support means for elevating and supporting the bottom of the garbage can, said bottom support means including pedestal means underlying and contacting the bottom of the garbage can when the can is engaged by said hook means and is substantially vertically oriented, said bottom support means providing open space below the bottom of the garbage can on the hook means side of the pedestal means into which the lower-inner portion of the garbage can may be tilted while on the pedestal means, for the purpose of disengaging the rim of the garbage can from the downwardly opening hook means; and, said bottom support means comprises a mounting plate and a bracket including an upper portion, an inner-end part which is attached to the mounting plate and an outer end portion which constitutes the pedestal means, said upper portion sloping upwardly as it extends outwardly from the mounting plate towards the pedestal means.

6. The apparatus according to claim 1, wherein said pedestal means includes a transverse support member spaced horizontally away from said hook means in the direction toward the diametrical center of the garbage can; and when the garbage can is supported on the apparatus in an upright position, said transverse support member contacting the bottom of the garbage can at transverse locations adjacent the outer circumferance of the bottom of the garbage can and offset from the center of the garbage can in directions toward and away from said hook means.

7. The apparatus according to claim 6, wherein said transverse support member is sized larger than the diameter of the bottom of the garbage can and said bottom support means further includes a lateral support member which contacts a portion of the lower external surface of the garbage can.

8. The apparatus according to claim 5, wherein:

(a) said mounting plate including distal mounting surface portions and a central portion separating said mounting surface portions, said central portion including a slot and being offset in respcet to said distal mounting portions in a direction towards said bracket outer end portion to define a bracket receiving space between said distal mounting portions; and, (b) said bracket comprising two havles, each having:

(1) an inner-end part receivable within said bracket receiving space defined by said mounting plate central portion for supporting said bracket halves, said inner-end part including a flange extending into said central portion slot, and (2) an elongate upper portion angularly disposed with respect to said inner-end part to extend upwardly and outwardly from said inner-end part to support said outer end portion.

9. An apparatus for supporting a garbage can from being tipped over by an animal, comprising:

(a) downwardly opening hook means adapted to engage an upper-rim portion of the garbage can;

(b) bottom support means for elevating and supporting the bottom of the garbage can, said bottom support means including pedestal means for underlying and supporting the bottom of the garbage can at locations off set from the center of the garbage can bottom in the direction away from said hook means when the garbage can is engaged by said hook means and is substantially vertically oriented;

(c) said bottom support means providing open space below the bottom of the garbage can on the hook means side of the pedestal means into which the lower-inner portion of the garbage can may be tilted while on said pedestal means; and, (d) said pedestral means contacting the bottom of the garbage can a distance sufficiently horizontally outwardly from said hook means to enable the rim of the garbage can to disengage from the downwardly opening hook means when the garbage can is tilted into said open space.

10. The apparatus according to claim 9, wherein said bottom support means further comprises:

(a) a mounting plate;

(b) a bracket carried by said mounting plate including:

(1) an inner-end part engageable with said mounting plate, and (2) an upper portion extending substantially horizontally outwardly from a said mounting plate; and, (c) a transverse support member which includes said pedestal means, said transverse support member being carried by said upper portion horizontally outwardly of said hook means for underlying and upwardly supporting the bottom of the garbage can when the garbage can is supported on the apparatus in an upright position.

11. The apparatus according to claim 10, wherein:

(a) said mounting plate includes distal mounting surface portions and a central portion separating said mounting surface portions, said central portion being offset in respect to said distal mounting portions in a direction toward said transverse support member to define a bracket receiving space, said central portion also having portions defining a slot;

(b) said bracket comprising two halves, each of said two halves having:

(1) an inner-end part receivable within the bracket receiving space defined by said mounting plate central portion, each of said inner-end parts including a flange extending into said central portion slot, and (2) an elongate upper portion agularly disposed with respect to said inner end part; and (c) said transverse support member including an elongate body portion and terminal end portions extending angularly of said body portion, said terminal end portions being detachably engageable with said bracket upper portions.

12. The apparatus according to claim 11, including friction means carried by said transverse support member, said friction means adapted to contact the bottom of the garbage can for restricting relative sliding motion between the bottom of the garbage can and said transverse support member.

* * * * *